United States Patent [19]

Ellen

[11] Patent Number: 4,487,101

[45] Date of Patent: Dec. 11, 1984

[54] DIGITAL SOLID STATE RECORDING OF SIGNALS CHARACTERIZING THE PLAYING OF A MUSICAL INSTRUMENT

[76] Inventor: Leonard W. Ellen, Briarmead, Chiltern Rd., Ballinger, Gt. Missenden, Buckinghamshire, England

[21] Appl. No.: 352,144

[22] Filed: Feb. 25, 1982

Related U.S. Application Data

[63] Continuation-in-part of Ser. No. 85,120, Oct. 15, 1979, abandoned.

[30] Foreign Application Priority Data

Oct. 18, 1978 [GB] United Kingdom ..... 40970/78

[51] Int. Cl.[3] ..... G10G 3/04

[52] U.S. Cl. ..... 84/462

[58] Field of Search ..... 84/1.01, 1.02, 1.03, 84/1.1, 1.27, 1.24, 1.28, 115, 345, 462, DIG. 29

[56] References Cited

U.S. PATENT DOCUMENTS

| | | | |
|---|---|---|---|
| 3,604,299 | 9/1971 | Englund | 84/1.03 |
| 3,610,799 | 10/1971 | Watson | 84/1.01 |
| 3,683,096 | 8/1972 | Peterson et al. | 84/115 |
| 3,781,452 | 12/1973 | Vauclain | 84/1.28 |
| 3,868,882 | 3/1975 | Fukui et al. | 84/462 |
| 3,890,871 | 6/1975 | Oberheim | 84/1.01 |
| 3,905,267 | 9/1975 | Vincent | 84/115 |
| 3,926,087 | 12/1975 | Griffis | 84/345 |
| 3,926,088 | 12/1975 | Davis et al. | 84/462 |
| 3,955,459 | 5/1976 | Mochida et al. | 84/1.01 |
| 3,955,460 | 5/1976 | Southard | 84/115 X |
| 4,080,863 | 3/1978 | Groeschel | 84/1.27 |
| 4,088,051 | 5/1978 | Ellen | 84/1.24 X |
| 4,132,141 | 1/1979 | Campbell et al. | 84/115 |
| 4,172,403 | 10/1979 | Campbell et al. | 84/1.28 |
| 4,191,083 | 3/1980 | Wilcox et al. | 84/1.28 |
| 4,215,619 | 8/1980 | Budelman et al. | 84/1.28 |
| 4,351,221 | 9/1982 | Starnes et al. | 84/1.28 |
| 4,387,617 | 6/1983 | Kato et al. | 84/1.01 |
| 4,402,244 | 9/1983 | Nakada et al. | 84/1.03 |
| 4,406,203 | 9/1983 | Okamoto et al. | 84/1.03 |
| 4,454,796 | 6/1984 | Inoue et al. | 84/1.03 |

*Primary Examiner*—S. J. Witkowski

*Attorney, Agent, or Firm*—Wolf, Greenfield & Sacks

[57] ABSTRACT

A recording and playback system for keyboard musical instruments in which data characterizing the operation of a keyboard of the instrument is recorded in solid-state memory in the form of words specifying keys for which changes of state have taken place together with data words specifying the time intervals between such changes, both types of data words being recorded in a continuous sequence of addresses in memory and the timing signals being distinguishable from the change-of-state signals by the use of pre-arranged codes, different for each type, within the range of codes available for use as data codes; such data being subsequently played back by the system in such a manner as to cause the musical instrument to reproduce the original performance.

7 Claims, 8 Drawing Figures

PRIOR ART

3x5x 32 = 480 BITS

8 BITS/BYTE x 80 BYTES/$\frac{1}{50}$th SEC.x 50 x 300 SEC.=9,600,000 BITS

S = DATA SPECIFYING A STOP CHANGE
N = " " " NOTE "
↓ = ON ↑ = OFF (IMPLIED IN THE DATA)
T = DATA SPECIFYING A TIME INTERVAL

DIGITAL SOLID STATE RECORDING OF SIGNALS CHARACTERIZING THE PLAYING OF A MUSICAL INSTRUMENT

The present invention relates to a recording and playback system for a keyboard musical instrument, and is a continuation-in-part of my application Ser. No. 85,120, filed Oct. 15, 1979, and now abandoned.

BACKGROUND OF THE INVENTION

The ability to reproduce music by operating musical instruments by mechanical means can be traced back at least to the sixteenth century. All such systems require some form of memory and this has in the past taken many forms, notably pins set in cylinders or discs, or holes punched in paper or card. More recently the required information has been stored magnetically on tape or disc, and it is now possible to store such information in solid-state memories requiring no mechanical movement to record (write) and playback (read). The present invention is concerned primarily with the use of solid-state memory, although it may be, and usually would be, associated with magnetic recording used as back-up.

It is necessary to draw a distinction between digital recording of information characterising the actions of the musician in playing an instrument and the recording of a digitised version of an analog electrical signal derived from the sound of the instrument by means of a microphone or, in the case of certain modern instruments, derived from the signal fed to a loudspeaker. The latter method requires the use of a very large number of bits of memory and is, at present, not practicable in solid-state except possibly for very short bursts of sound. The present invention is concerned only with the digital recording of information characterising the actions of the musician. The present invention assumes that the musical instrument to be recorded and played back is, or can be made, able to furnish signals in electrical form characterising the operation of the instrument and is, or can be made, able to playback when supplied with such signals generated electrically. This means that the invention is, for practical purposes, restricted to keyboard instruments such as the organ, piano and harpsichord which can be fitted with electrical contacts on all the controls, but includes such instruments as the xylophone and vibraphone which, although not normally played from a keyboard, can be so adapted, as has been done in the past in organs used for playing popular styles of music.

It will be shown that where proper reproduction of the instrument requires the storage of signals characterising the force with which notes are struck, the present invention is capable of storing such signals and possibly of assisting in their generation but no claim is made for teaching any basic method of deriving such signals.

It is desirable to draw a distinction between two basically different methods for generating the signals needed for the recording process. Recording in "real time" requires the music to be actually performed by a musician having the necessary degree of manipulative skill; but it is also possible with a suitable recording medium to key-in, without reference to lapse of real time, the necessary data without recourse to the services of a manually-skilled musician. The latter process is very time-consuming and tedious and usually results in an impersonal playback which is unacceptable to serious musicians. The present invention is mainly directed to real-time recording of "live" performances, but it also affords the possibility of editing, by computer techniques, or even complete off-line recording, thus achieving the best of a combination of both methods. This is of value, for example, in changing the recorded registration (stop settings) of an organ without the need for the original performance to be repeated.

The cost of solid-state digital storage is at present in the order of a tenth of a cent (US) per bit. The number and range of notes and other controls used in a substantial piece of music is such that a high degree of economy in the use of such storage is necessary if the system is to be economic and practicable. This matter will be discussed in detail with reference to a fairly small pipe organ. It is to be understood that the arguments can readily be extended to large instruments.

OUTLINE OF THE PROBLEM

Figure 1:
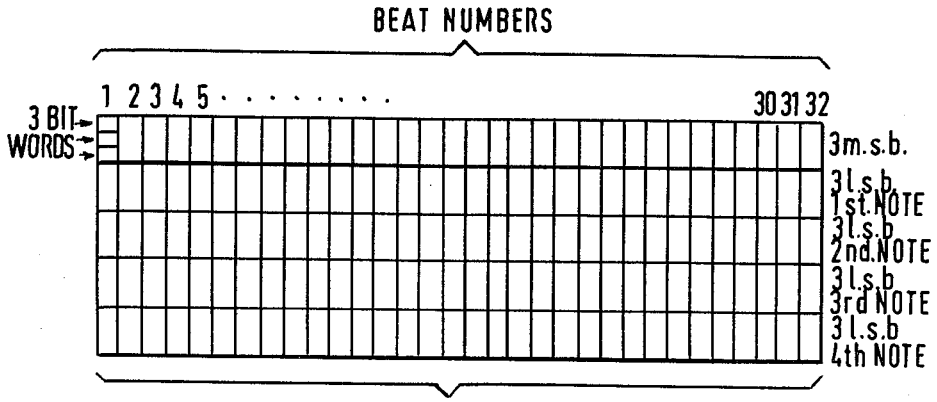
FIG. 1 is a memory map of the Wilcox system.

A typical small organ consists of two keyboards each of 61 notes (the "manuals") operated by the organist's hands and one keyboard of 32 notes, the pedals, operated by the feet. There are also a number of "stops" which enable the organist to couple various ranks of pipes, or other tone generators, to the keyboards. Large organs may have as many as seven or eight keyboards and over a thousand stops.

A recording system worthy of consideration by serious musicians must be capable of recording anything which an organist (or possibly two organists in duet) can play on the instrument and must include all controls such as the stops as well as the keyboard notes. There must be no constraint on the organist to play only limited combinations or sequences of notes or to conform to any time-pattern such as might be imposed by any form of metronome (i.e. in electronic terms, clock pulses). There must be no limitation on the extent of frequency of stop changes. As there will normally be some 30–60 stops on a small organ, or hundreds on a large one, it is clear that a satisfactory recording system must be able to deal with such numbers of ON signals simultaneously together with a substantial number of notes which may be played simultaneously on the manuals and pedals. Provision must also be made to deal with signals from the "swell pedals" which control the volume of sound by means of movable shutters on boxes in which some of the pipes are enclosed. Thus a reasonable figure for the number of channels which may be simultaneously ON for a small organ is certainly not less than 80 and is considerably higher for large instruments.

Consideration must also be given to timing requirements. Although measurements of nanoseconds are commonplace in modern technology, it would be absurd to suppose that such an order of accuracy is necessary in reproducing a musician's movements. Experiment has shown that timing errors of 1/25th second are detectable by a trained ear. A satisfactory standard of accuracy has been found to be 1/50th second and this figure will be assumed in this description, though the system to be described can easily provide a substantial improvement on this figure, if required, with only a trivial increase of storage capacity.

An inevitable constraint which must be accepted in any recording system is the limit on the duration of the recording imposed by the amount of the recording medium, in this case the solid-state memory, that can reasonably be provided. The duration available is determined both by the amount of memory made available and by the efficiency with which it is used.

A very significant improvement in this efficiency over that of prior art is a principal feature of the system of this invention.

The improvement obtained is dependent in a somewhat complex manner upon the nature of the music recorded and is therefore not quantifiable in precise terms, but can be stated as being broadly thirty to one hundred times better than known systems. The cost of storage for a given duration is correspondingly reduced, thus making the system of the invention viable for worthwhile durations.

COMPARISON WITH PRIOR ART

By way of demonstrating the economy achieved by the system of the present invention, an examination will be made of a system described by Wilcox in U.S. Pat. No. 4,191,083. A memory-map for the Wilcox system is shown in FIG. 1.

Wilcox describes a system, using solid-state memories, which is such that within the amount of memory suggested by Wilcox it is only possible to record and playback a short sequence of simple chords played on one keyboard of an organ as an accompaniment for a short piece of popular music and furthermore this must be played to the strict-tempo restraint of an electronic metronome and can only run for 32 "beats" of the metronome. It would be theoretically possible to overcome these limitations by the provision of a much larger amount of solid-state storage, but as will now be shown the increase required to provide for the full recording of a substantial piece of music is such as to render the system uneconomic, and barely practicable even if cost is ignored.

The following constraints have to be adhered to:

1. Recording is limited to one keyboard.
2. The number of notes sounded simultaneously is limited to four.
3. The four notes thus permitted must be within 7 semitones of each other.
4. The notes must be played in synchronism with a metronome.
5. The number of metronome beats is limited to 32.

None of these constraints is acceptable for serious recording. All of them arise from the need to economise in memory capacity. For a small organ, removal of constraints 1 and 3 requires a memory increase of nearly three-fold to at least eight bits per data-word. As explained above, provision for the recording of both stops and notes, together with miscellaneous controls, requires a memory increase of at least 20-fold, from 4 to 80, to reduce constraint 2 to barely acceptable limits. Constraints 4 and 5 are interdependent as the duration obtainable with this system is inversely proportional to the beat rate. To allow free-expression recording, i.e. without metronome restraint, the channels (i.e. the notes, stops, etc.) must be sampled about 50 times per second. This is equivalent to running the metronome at this speed, and memory giving a capacity of 32 beats would then furnish a recording duration of only 0.64 second.

Figure 2:
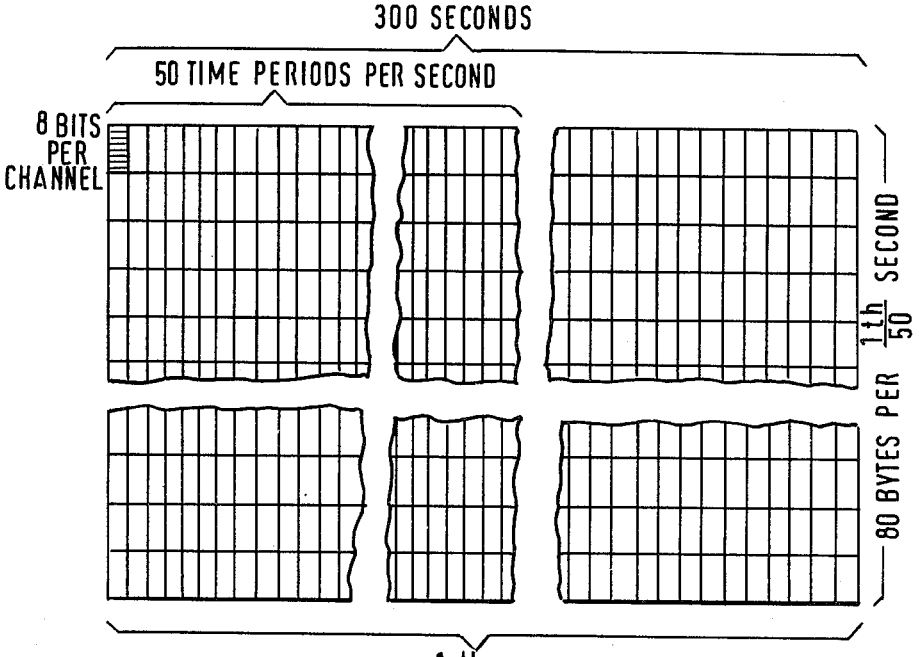
FIG.2 PRIOR ART
FIG. 2 shows the memory map of FIG. 1 expanded to contain five minutes of unrestricted recording.

Thus the Wilcox system expanded to accommodate the requirements of a normal musical performance on a small organ would require an 8-bit data word for each of at least 80 channels 50 times per second of the required duration. The minimum requirement for the duration of what might be considered a worthwhile recording is obviously subjective, but can scarcely be taken as less than 5 minutes. Thus the memory capacity needed for such an expansion of Wilcox will be not less than 8 bits per word for 80 channels 50 times per second for 300 seconds = 9.6 million bits. Assuming a cost of 0.1 cent per bit this represents a capital investment of very nearly 10,000 dollars and, using the maximum size of memory chip currently available (64K bits) an installation of 150 chips would be needed. In fact, it would be preferable to record the whole bit-stream from a 256-channel multiplexer running at 50 scans per second (=3.84 million bits in 5 minutes). FIG. 2 shows the memory map of FIG. 1 expanded to contain 5 minutes of unrestricted recording.

Thus it is quite clear that the Wilcox system was never intended to provide substantial full-scale recording and this is made quite clear in the Abstract of the Wilcox U.S. Pat. No. 4,191,083. Even with the increased size of solid-state memories now available the situation is substantially unaltered.

It is of course quite practicable to use the Wilcox system to play back the same simple short accompaniment passage repeatedly for 5 minutes—or, indeed, continuously for any period—but this is of no value whatever for the serious recording of music which seldom, if ever, requires repetition of a mechanical nature.

It will now be shown that by the use of features not found in the Wilcox system the system of the present invention is able to record fully a substantial piece of music with no constraints upon the musician and with an economically viable amount of solid-state memory. An example will be given of a complex piece of about six minutes duration recorded in a small fraction of the amount of memory needed to accommodate it in an expanded Wilcox system.

Outline of the principles of the system of the present invention:

For a small organ consisting of two 61-note manuals, 32 pedal notes and up to, say, 64 stops and other channels, a total of 218 channel codes are required. An 8-bit data word gives 256 combinations, which will provide a separate code to describe each channel with 38 spare codes. For the purpose of this description no distinction is necessary between stops, notes or other channels and they will be referred to collectively as channels. Unlike Wilcox, no attempt is made to economise in memory usage by using only partial addresses for channels; full channel addresses of 8 bits are always used in a small organ. The matter of addressing in a large organ requires a modification to be described later. The use of full addressing removes all constraint upon the positions of permissible ON channels within the instrument. Clearly this is in itself within a routineer's extension of Wilcox, but it makes no contribution to memory economy; indeed, the reverse is true. It is merely an essential step to remove unacceptable restraints.

The first major economy of memory is effected by recording only changes of state. Whereas Wilcox records the fact that a channel is ON repetitively at every beat so long as the channel remains ON, the system of the present invention records the address of a channel once when it changes from OFF to ON and once again when it changes from ON to OFF no matter what interval of time may elapse between changes. Thus, instead of taking up a memory address for each fiftieth of a second for which a channel is ON, the channel address is recorded only twice for the whole of its ON period.

The average period for which a note is ON varies widely according to the type of music. It is seldom less than 1/10th second and may, exceptionally, be as long as a minute; half a second is probably a reasonable average. Thus it will be seen that the method of recording only the changes always effects an economy of at least 2:1 and averages an economy of some 12:1 so far as keyboard notes are concerned. For the recording of stops the economy is much greater, as they are commonly left on for long periods, often the whole of a piece of music lasting possibly 5 minutes or more. Using Wilcox's method, a single stop left on for 5 minutes would account for $50\times60\times5=15{,}000$ memory words; in the system of the present invention such a stop would account for only two channel words plus two timing words as will be described later.

Taking advantage of the fact that a slower response would be acceptable for the operation of stops—say 1/5th second instead of 1/50th—a routineer might effect an economy in Wilcox's method by providing a separate, slower, recorder for stops; but this would still leave a clear advantage of about 400:1 in favour of the method of the present invention. As large numbers of stops are commonly left on for long periods such an advantage is of considerable importance.

In Wilcox's method the moment in time when each channel is to be turned on or off is indicated by the position in memory at which the channel's address appears for the first, and subsequently the last, time. In the system of the present invention the location in memory only shows the order in which changes occur and does not indicate the timing of those events. It is therefore necessary to record additional words to provide this information. These timing signals are inserted into the same memory chips as the channel words and any codes from the set of 256 codes of the 8-bit word can in principle be allocated for this purpose provided that the same codes are not used for channels. However, it is very desirable, for convenience in hardware design or programming, that they should form a subset of consecutive numbers so that they can be easily identified. When the system is to be microprocessor-controlled it is convenient to use the group of 32 codes immediately following the sequence of 32 used for the pedals i.e. those which would be used for extra pedals if it were the practice to provide as many pedals as there are notes on a manual. This is only a matter of convenience and other arrangements may be preferred. If the system is to be constructed in hard-wired logic there will be no constraint to use 8-bit words and it may be convenient to provide an extra bit at every memory address, making 9-bit words, the extra bit being recorded as a 0 (say) for channel addresses and as a 1 for timing signals. Such an arrangement would facilitate recognition by hard-wired logic, and would incidentally provide a range of 256 timing codes instead of the more restricted number proposed for microprocessor control.

A sequence of, say, 32 timing codes will provide for a zero time code and 31 further codes indicating time intervals in fiftieths of a second up to 31/50th=0.62 seconds. In practice this is a sufficient range as generally the events occur at closer intervals than 0.62 secs, and when the intervals are greater it is merely necessary to record two or more time codes in consecutive memory addresses. If sufficient time codes are not available after allocating channel codes (due, for example, to an exceptionally large number of stops on a small organ) it will be necessary to adopt large-organ design, described later.

It will be seen that the principle of using timing codes which are readily distinguishable from channel codes allows the whole range of codes, covering both timing and channel addressing, to be recorded in a common sequentially addressed memory bank. This principle is not found in Wilcox, where no timing codes are recorded, the timing information residing in the memory address at which channel addresses are recorded. The significant factor in the system of the present invention is that the inclusion of timing words in the recorded data eliminates multiple repetitions of channel address recordings, sometimes amounting to hundreds or even thousands of repetitions, at the cost of recording only one, or possibly two or three, timing words.

A further major advantage arising from this principle is that it is no longer necessary to allocate large blocks of memory to record the maximum number of channels which might be ON at each instant of time when in fact the number actually ON is, for most of the time, much less than the maximum. It will be seen from the memory maps, FIGS. 1 and 2, that in the Wilcox system the excess of provision over actual usage is completely wasted, and if for example provision were made for, say, 15 simultaneous notes and only a one-note-at-a-time melody were recorded then 14/15ths of the available memory would be wasted. When the Wilcox system is expanded this wastage renders the system clearly uneconomic, whereas in the system of the present invention every available memory cell is used to record useful information and recording can continue until the memory is completely full, with no wastage. This is made clear in FIG. 3 which is a memory map for the system of the present invention. FIGS. 4, 5, 6 and 7A and 7B are also illustrative of the system of the present invention and will be referred to subsequently.

Figure 3:
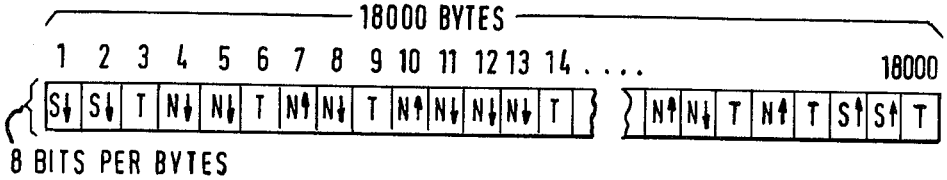
FIG. 3 is a memory map for the system of the present invention.

The memory words in FIGS. 1, 2 and 3 have been numbered in decimal notation for ease of reading, but it will be understood that in accordance with normal computer practice they will in fact be numbered in the binary system.

Timing codes are recorded between any two events which are separated by a significant period of time irrespective of whether the two events refer to the same or different channels. Events which occur within the same 1/50th second timing period are regarded as simultaneous and are recorded in consecutive memory addresses; there is no need to record a "zero time" signal as this is implied by the absence of a time signal. Thus it will be seen that when one note, or a group of notes, is held on continuously while other notes are being changed more frequently, the timing of the former is determined by the summation of the event-timings of the latter. Thus no individual timing of particular channels occurs unless it so happens that no other event occurs within the time period in question. In addition to solving the otherwise difficult problem of timing overlapping events, this principle is also correct musically as the relative timing of the channels is of far greater importance than the absolute duration of individual notes.

Provided that arrangements are made to ensure that all channels are OFF at the commencement of the playback of a piece of music it is not necessary that the recorded data should show whether an event was a "turn-on" or a "turn-off" event, as these two types of event must obviously occur alternately for any one channel. It therefore suffices merely to record the address of the channel giving rise to the event. On playback the occurrence of the address in the memory is taken as an instruction to reverse the state of that channel. It would be easy to include an additional bit specifying the direction of the change, but careful consideration shows that this would do no more than prevent a single error from becoming a double error. As even a single error is totally unacceptable there is no merit in preventing its doubling.

As an example of a piece of organ music we may consider the Toccata by Widor which is a well-known piece often played at weddings. This piece contains approximately 6400 notes and takes about 6 minutes to play. As already explained it is essential for proper recording to include recording the stops, but it is interesting to consider the situation if these are omitted. For most of the piece one of the organist's hands plays a rapid sequence of single notes while the other hand plays 3- or 4-note chords in which the 3 or 4 notes are nominally simultaneous. For the system of the present invention the worst case occurs if all the notes are considered as separate in which case each note will have its address recorded twice and will account for two timing words giving the duration of the note and the interval between it and the next—a total of 25,600 words. But in practice many of the notes will certainly be recorded as simultaneous and only about 5000 time codes will be needed, giving a total of about 18,000 words=144,000 bits at 8 bits per word. Wilcox, expanded by a routineer, would need to record at least 6 words (i.e. 6 possibly simultaneous notes) for each 1/50th second amounting to 108,000 words=864,000 bits=six times the requirement of the system of the present invention. When allowance is made for the inclusion of a minimum of 30 stops (and this is essential for proper recording) the memory requirement for the system of the present invention is increased by a trivial amount, about 240 words, whereas Wilcox must be increased a further six-fold to 648,000 words=over 5 million bits, giving the system of the present invention an advantage of about 36:1.

The Widor Toccata is a fast-moving piece of music and this tends to favour Wilcox; for most music the system of the present invention shows to even greater advantage. Thus it will be seen that the provision of a memory for 32K-bytes will allow the recording of worthwhile amounts of unrestricted organ music, and with the use of currently available chips this can readily be extended to 48K- or 64K-bytes while keeping costs within the limits of a marketable system.

It is clear that in the present, or foreseeable future, stage of the art it is unlikely that even with the economies herein described it will be practicable to store very large amounts of music (e.g. the complete works of a prolific composer) in solid-state. Nevertheless the ability to record and play back performances lasting possibly a quarter of an hour is of considerable value. For tuition and practice a pupil may immediately hear his performance played back on the actual instrument rather than via a microphone and loudspeaker and without tape re-winding. A church organist may impartially assess the impact of his music as heard by the congregation at remote parts of his church rather than from the restricted position of the console—for which purpose loudspeaker reproduction is useless.

For the ultimate production of a conventional audio recording, perfection of playing may first be achieved in solid-state recording with no risk of spoiling by extraneous noises. The audio recording can then be made from solid-state playback and if it is marred by unwanted noises it can easily be repeated without requiring the musician to play it again. The need for simultaneous perfection of both artistic performance and audio recording is thus avoided.

When it is desired to retain a recording permanently the data recorded in solid-state may be transferred to digital tape or disc and subsequently read-back to solid-state when reproduction is required. At reasonable cost magnetic disc recordings can be read at the rate of some 60,000 bytes per second, including error checking. Thus, a solid-state memory of suitable size to give, say, 10–20 minutes of music playback can be loaded from disc in about 1 second. A single-sided 8 inch disc can therefore provide some 3 hours of music, continuous except for one-second disk reading interruptions at suitably-chosen moments. If necessary, these interruptions could be avoided by known DMA (direct memory access) techniques. The techniques for digital magnetic recording of data are well-known and do not need to be described herein.

It will be clear that with the necessary data recorded in solid-state random-access memory it is possible to carry out a wide range of computer-like operations on the data. For example, it will be known precisely which channel codes have been used to record the stops and it will therefore be possible to search for and erase such data and to insert alternative stop settings thus enabling the keyboard part of a recording made on one organ to be used on a different organ having different ranks of pipes for which the original stop-settings would be unsuitable. Standard programming instructions are available for moving large blocks of data to make room for additional stops. Similarly, it will be known which codes specify the keyboard notes and it will therefore be possible to transpose the key in which the music is played by adding or subtracting the desired number of semitones (i.e. the extent of the transposition) to all the data bytes referring to keyboard notes, with provision to avoid overflow from the ends of the keyboards.

It will be understood that, for use by professional musicians, errors cannot be tolerated. The accuracy of solid-state recording is very high and it has not been found necessary to take any special steps to detect errors when playback is direct from original solid-state recordings. However, when the data has been read back from magnetic tape or disc there is a risk of errors. Normal error-checking techniques would of course be used, but the following additional check has been found useful. The inherent nature of the system is such that, since all channels are initially OFF at the start of a piece of music and are returned to an OFF state at the end, all channels addresses must, in a complete recording, occur an even number of times. After reading the data for a piece of music from disc or tape a simple program is run to check this. Timing codes are omitted from this test as these obviously do not occur in pairs; this does not detract seriously from the value of the test, as timing errors are less disastrous than wrong notes and in any case such errors may well change timing bytes into single channel bytes which will be detected. If any odd-number error is found, a warning is given before playback from the organ starts, or playback may be inhibited. Compensating errors are possible, but unlikely. The check can be carried out on a 32Kbyte memory in about one second.

The above discussion of the invention has been given with a view to enabling a ready understanding of the basis of the invention. Before describing a typical embodiment of the invention, a more detailed general description will now be given, in respect of the application of the invention to an organ.

A multiplexing system of known form, for example as disclosed in my U.S. Pat. No. 4,088,051, is provided at the organ console, scanning the organ keys, pedals and stops at a suitable rate, for example 50 times per second. Assuming a 256-channel system, the data output of the multiplexer is continually written into a 256-bit random-access memory (RAM) which thus contains a continually updated record of the state of each channel. This is referred to as the "working store". As each channel is examined by the multiplexer its state is compared with its state at the previous scan as recorded in the working store, this comparison taking place before updating of the store. If no difference is detected between the previous and new states of the channel, no action is taken. If a change of state is detected, however, the 8-bit address of the channel is recorded in a large-capacity RAM which be referred to as the "main store". Errors are very unlikely and the mere presence of the address is used to signify that the channel state is to be changed.

For the example given, a period of about 78 microseconds is available for each channel and this allows ample time for detecting the difference, recording, and advancing the main store to its next storage location. Parallel storage of the 8 bits as a single byte is preferred, but there is ample time for serial storage if desired. This remains true for larger instruments.

When several notes are played and/or released simultaneously, or nearly so, the changes are detected and recorded sequentially but all are dealt with within one scan (1/50th sec) which in practice suffices.

It is thereafter necessary to record the lapse of time before the next change occurs. This may conveniently be done by counting the number of scans which occur without any changes being detected. An 8-digit binary counter may be used giving a maximum count of 255, giving a time resolution of 1/50th sec and a maximum time of about 5 seconds. Alternatively, a sub-set of, say, 32 codes not required as channel addresses may be used, as already described, and timing is then limited to a correspondingly smaller period.

Each time a significant time interval occurs between detected note or stop changes, a record of the state of the timer-counter is written into the main store in its proper sequence between the relevant note/stop records. Periods in excess of the timer's maximum capacity are recorded as two or more consecutive timings. When a time period has been recorded, the timer is reset to zero.

Note/stop changes and timing signals are recorded sequentially in the same main store and it is therefore necessary to distinguish between the two types of data either by means of an additional bit, making 9 bits in all for a 256-channel system or by the use of a small sub-set as already described.

When the recording is to be played back, the procedure is reversed. Provision is made for scanning the contents of the working store continuously at an appropriate rate (usually equal to the recording rate) either by means of a separate pulse generator and counter or, preferably, by allowing the organ multiplexer to run normally but with all notes and stops off. The data output of the working store is used instead of the console multiplexer to modulate the signal to the normal receiving demultiplexer associated with the sound generators, i.e. pipes and related apparatus. Alternatively, both sources may modulate the signals thus allowing superimposition of live and recorded performances.

A reset control sets the main-store counter to zero (or to a desired starting address) and sets all memory cells of the working store to "off". The first byte recorded in the main store is then examined and the category of the data is recognised as being a timer or a channel address. If it is a timer signal no action is taken until the timer, driven at an appropriate speed, reaches the count corresponding to the recorded byte, whereupon the main-store counter is advanced one step to deliver the next byte, and the timer is zeroed. When the code indicates a channel signal, the 8 bits are compared with the 8-bit addresses which are being sequentially applied to the working store and when these correspond—that is, when the working store stands on the specified note or stop—the state of the working store is reversed. The main-store counter is then again advanced one step. It is important, and natural, that the scanning order for replay is the same as for recording so that nominally-simultaneous changes are dealt with in a single scan. Thus the working store is updated at time intervals corresponding to the recording intervals and, being scanned continuously, furnishes an exact copy of the signal originally delivered by the console multiplexer during recording.

At the present time, the cost of memory storage devices is such that the abovedescribed solid-state storage system is too costly to be used for permanent records. Thus, the data is transferred to tape (or other media such as disc) for this purpose. This transfer follows well-established techniques. Any convenient bit-rate may be used, as the process is independent of the live recording. The bit-rate should be chosen to give the greatest reliability and accuracy. Error checking devices such as the use of parity bits and error-correcting codes may be used and provision may be made for a bit-by-bit check of playback against the solid-state memory before the latter is erased.

When a tape or disc is to be replayed, its data is first loaded into the solid-state store. This is merely a reversal of the tape or disc recording procedure and is in accordance with established techniques.

It is estimated that rapid complex organ music will require a storage capacity of up to possibly 3000 bytes per minute. This will vary widely according to the nature of the music but it is unlikely that the average bit-rate over a period of minutes will exceed 400 bits per second, assuming 8 bits per byte. It is therefore clear that data can be taped on simple equipment much faster than needed. It is therefore possible to record continuously with a reasonably small main store by dividing the store into two halves and taping one half while the other half is taking the live recording, interchanging the two halves alternately as they become full. Alternatively, data may be transferred to or from disc at high speed as already suggested.

Provision may be made for editing the solid-state recording. A visual display in hexadecimal form or in other well-known means such as a Visual Display Unit of the type used in computer work may be arranged to show the contents of any location in the main store and provision may be made to reduce the speed of playback at will to facilitate location of points at which editing is required. When thus identified, the contents of any main store location can be amended as required.

It is not believed necessary to give a complete list of possible editing instructions as they will be introduced in accordance with users requirements and would conform to orthodox computing techniques. Some indication of the possibilities has already been given.

Other likely features are 'JUMP to ZERO', causing playback to be repeated endlessly, for example to produce a repeated rhythmic pattern; conditional jumps, dependent upon the setting of a switch or the state of a repetitions counter; and 'STOP' instructions to separate different items contained in the same recording.

By arranging that the bytes relating to changes of notes or stops are serialised and transmitted directly to a receiver instead of, or in addition to, recording in a solid-state main store, an alternative to the known simple time-division-multiplex continuously-transmitted scan system is made available. Generally, not more than about ten notes are struck or released simultaneously, and these must be transmitted in about 1/50th sec, i.e. a maximum of about 500 changes per second. Allowing 8 bits per note-address, this requires a bit rate of transmission of about 4000 bits per second, which is a 3:1 improvement on the 12500 bits per second of full-scan transmission. The advantage becomes more marked in larger instruments, as one additional bit per byte doubles the channel capacity, whereas full-scan transmission requires twice the number of bits. For live transmission, the abovediscussed timing and editing codes serve no purpose.

Figure 6:
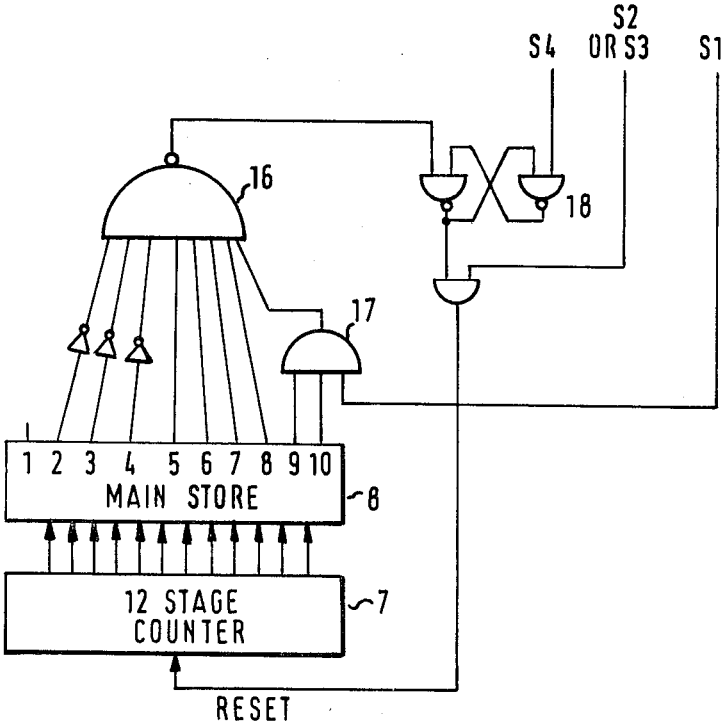
FIG. 6 is a block diagram illustrating a manner of executing a "return to zero" instruction.
Figure 4:
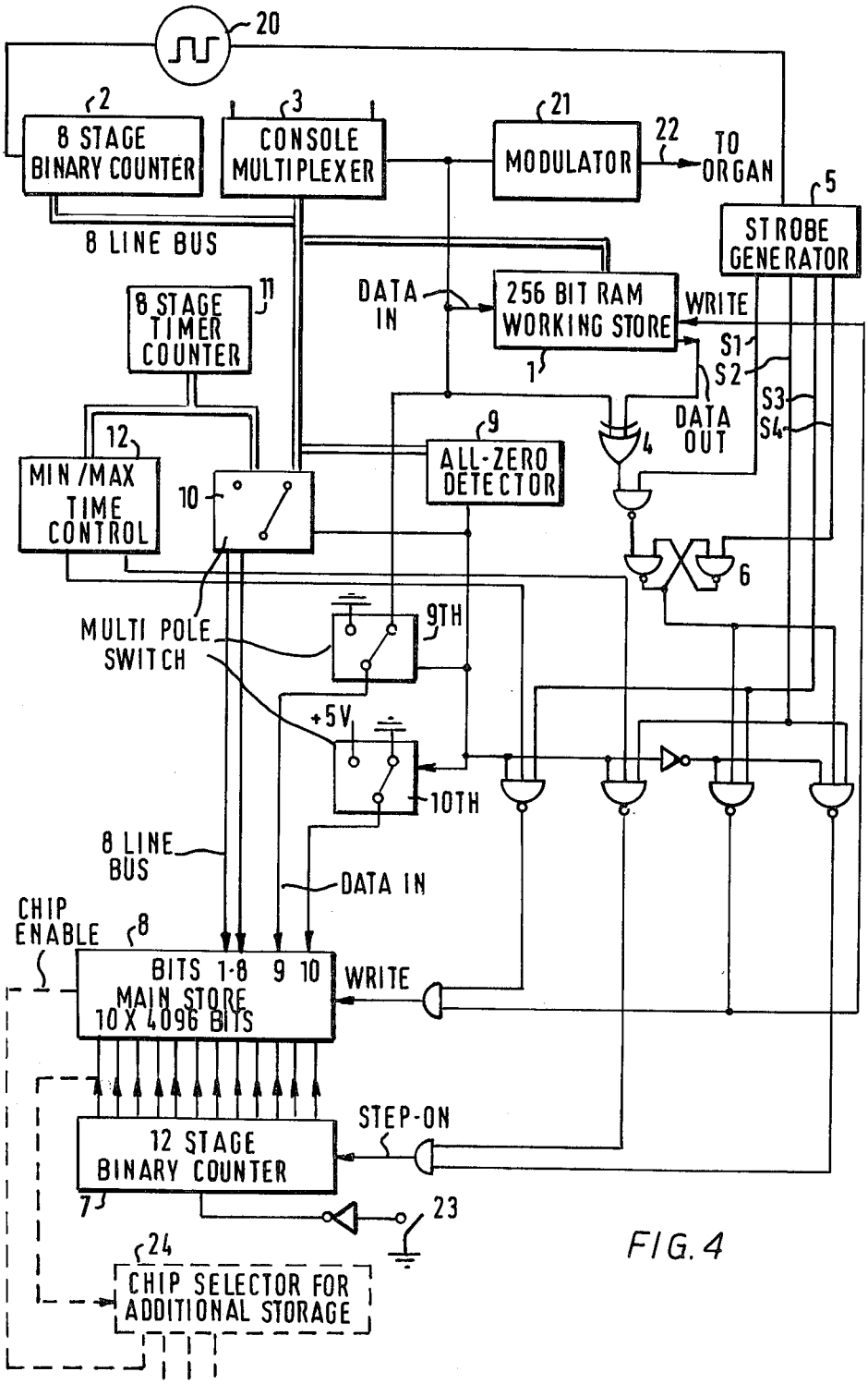
FIG. 4 is a block diagram of hardwired digital solid state recording system, in its recording mode, for a 256 channel time division multi-plex organ.
Figure 5:
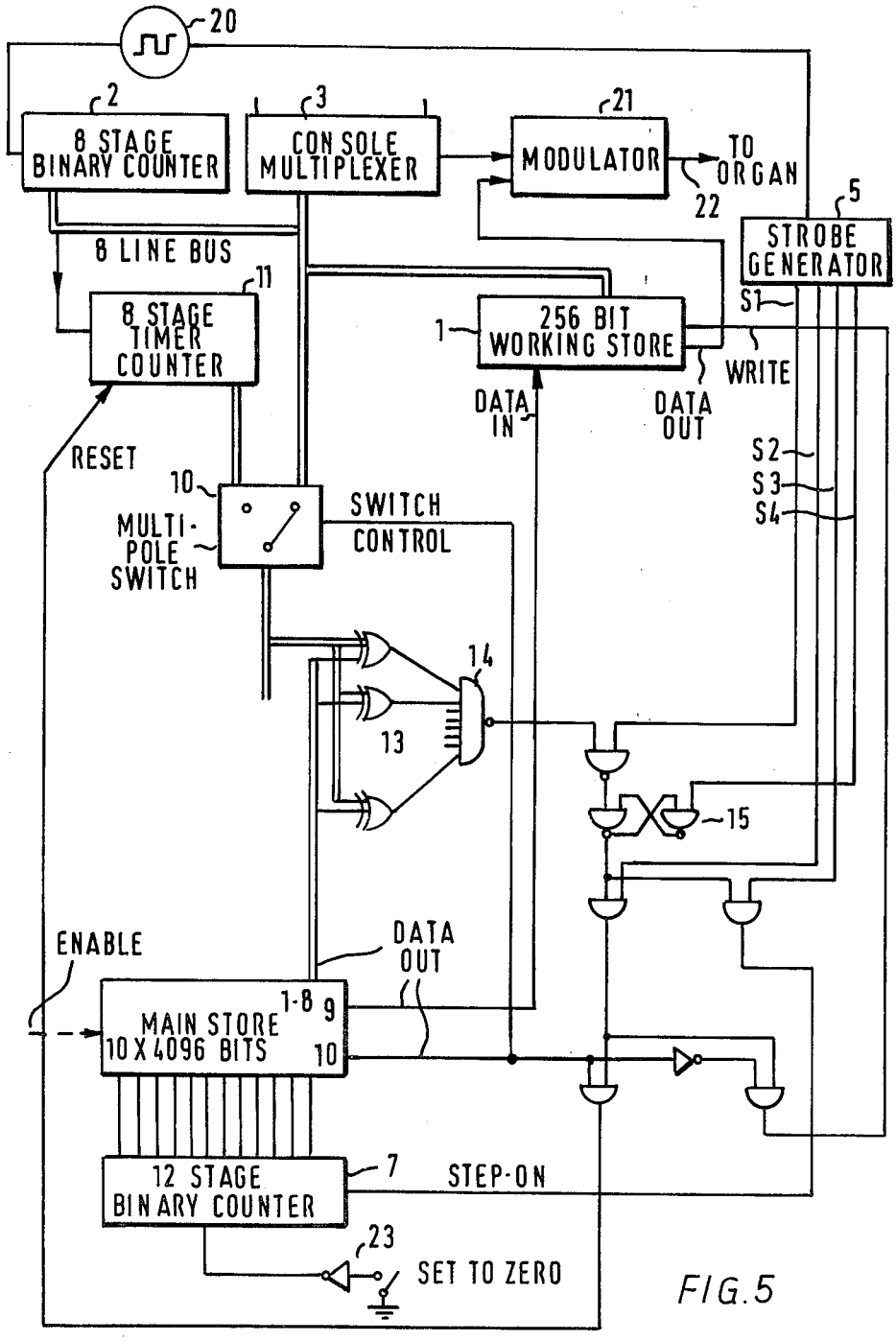
FIG. 5 is a block diagram of the system of FIG. 4 in the playback mode.
Figure 7A:
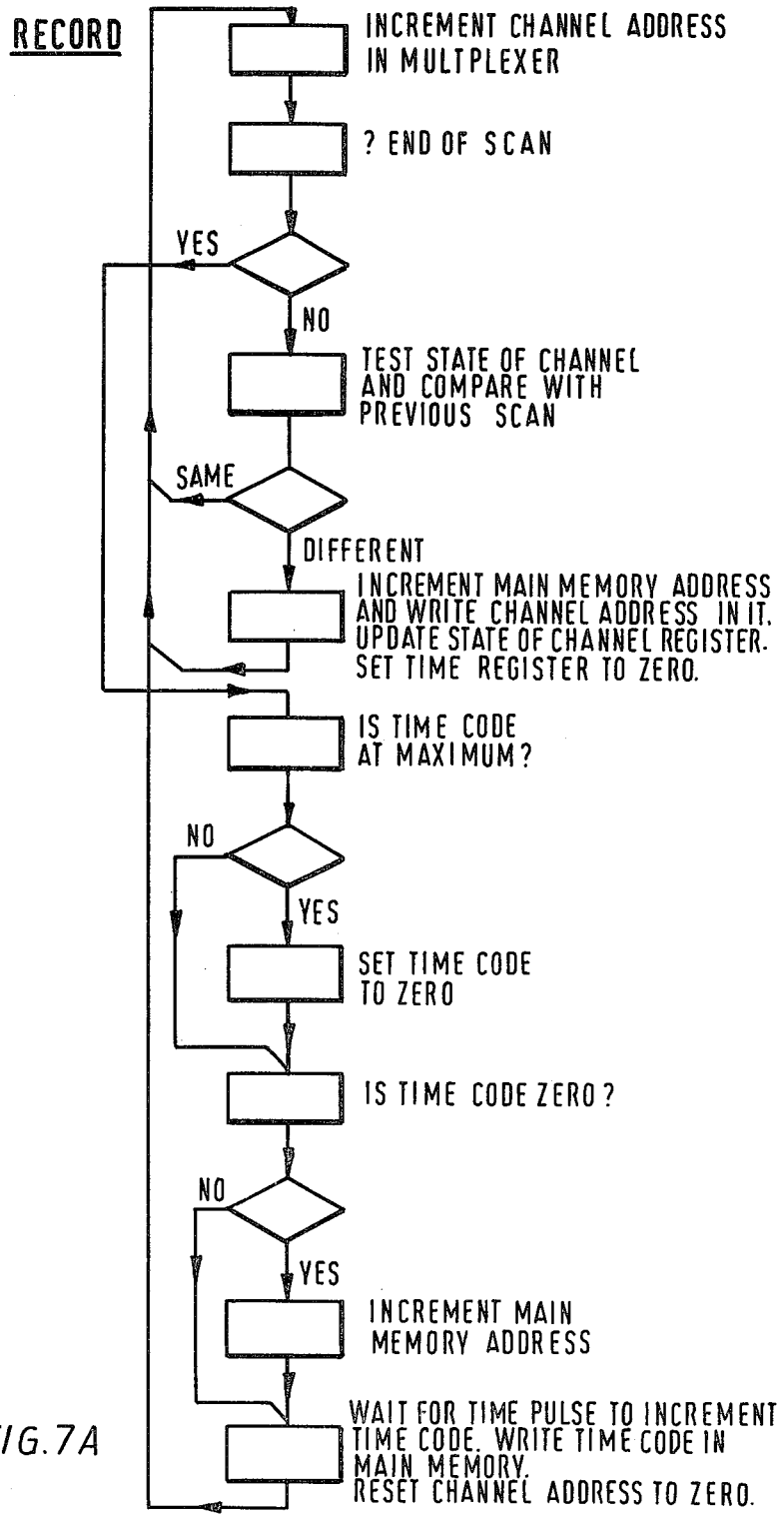
FIGS. 7A and 7B show flow charts for microprocessor control of the system of the invention.
Figure 7B:
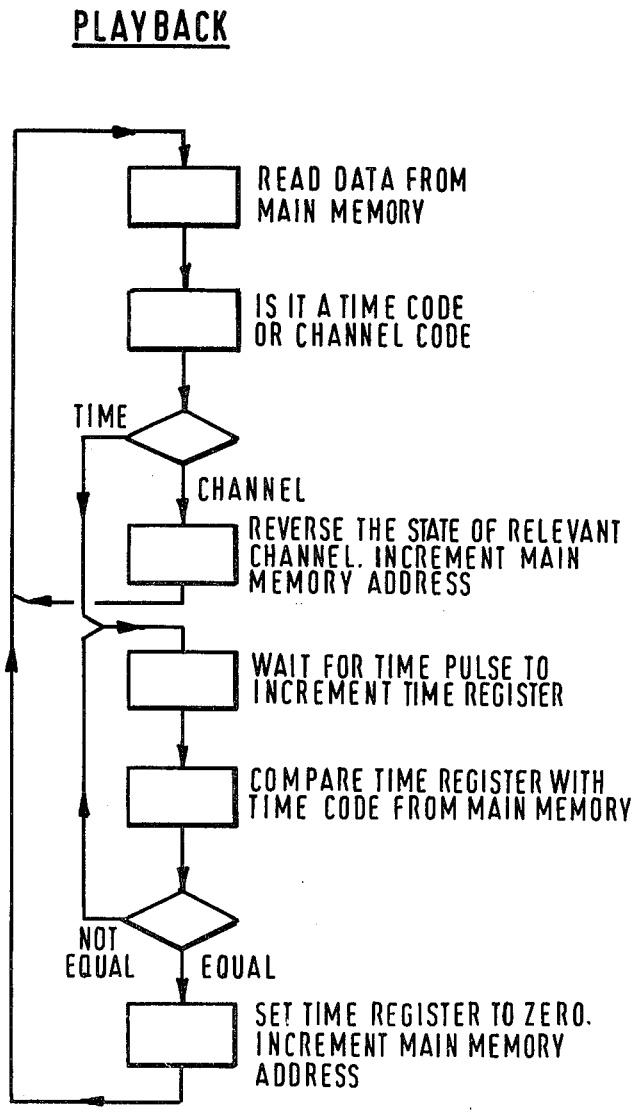

In order to make the invention clearly understood, reference will now be made to FIGS. 4 to 7A and 7B of the accompanying drawings which are given by way of example and in which:

FIG. 4 is a block diagram of hard-wired digital solid-state recording system, in its recording mode, for a 256 channel time-division-multiplex organ;

FIG 5 is a block diagram of the system of FIG. 4, in the playback mode;

FIG. 6 is a block diagram illustrating a manner of executing a "return to zero" instruction; and FIGS. 7A and 7B show flow charts for microprocessor control of the system of the invention.

In the arrangement shown in FIG. 4, a 256-bit RAM 1 forms the working store (discussed in the general description given above) and is addressed by the 8 stages of a multiplexing counter 2, so that each of its memory cells corresponds to a particular organ channel. The allocation of multiplexer channels to notes, stops, etc., may follow any desired pattern—for example, the system described in U.S. Pat. No. 4,088,051 (L. W. Ellen).

For a detailed description of the time-division-multiplex scanning of an organ, reference should be made to the said Patent Specification.

The output of the working store 1 and the output of the multiplexer 3 are continually compared by the exclusive-OR-gate 4 which outputs a "1" (high voltage) if the two differ, a "0" (low voltage) if they correspond.

For each channel, a sequence of 4 pulses is generated by a sequence generator 5 which may consist of a decoder such as an integrated circuit of type SN74155 driven by an oscillator 20, and the counter 2 stepping at least 4 times per channel. This counter 2 is reset to zero at each step of the multiplexer 3. These four pulses function as strobes S1, S2, S3 and S4 controlling the sequence of operations of the recorder. S1 senses the agreement or difference of the working store 1 and the multiplexer output and sets a latch 6 if there is disagreement. S2 steps the counter 7 controlling the main store address if this is necessary (i.e. if the record in the current address is channel data, or timing data which is to be retained). S3 applies a pulse to the write-control lines of both the working store 1 and the main store 8. S4 cancels the latch 6 in readiness for the next channel.

The main store 8 consists basically of 8 storage devices of type TMS 4044 (or equivalent) each of which furnishes 4096 one-bit storage locations. These together furnish 4095 8-bit bytes, which is sufficient for about one and a half minutes of complex music or much longer for simple music. This array may be duplicated or multiplicated almost without limit subject to consideration of cost using components of any suitable capacity currently available. Addressing of these main storage locations is under the control of the main-store counter 7 consisting of twelve binary stages for the basic 4096-byte capacity with additional stages to select storage groups if the capacity is to be larger. It is to be noted that this storage organisation is merely typical and may be altered as requirements dictate and the state-of-the-art permits.

The 8 data input lines to the main store are normally controlled by the eight stages of the console multiplexer counter 2. Thus the application of a "write" signal to the main store causes the address of the current channel to be recorded.

At one point of each scan of the console, either during an unused channel or during a synchronising pulse, the channel period is used for timing purposes. This is assumed to be the all-zero channel address which is easily identified by the return to zero of the most significant stage of the multiplexer counter operating an all-zero detector 9. At this point, by means of eight pairs of gates embodied in a multi-pole electronic switch 10, control of the main store data inputs is switched from the channel address lines to the outputs of a timer-counter 11. Each time the scan passes this point the current state of the timer is written into the main store 8, but the address location in the main store is not necessarily advanced. Assuming that a limited sub-set is used for timers, some of the 8 bits will be permanently wired to a suitable code. Thus, if no channel differences occur, the timer 11 is advanced once per scan and the time-elapsed data in the main store 8 is updated by overwriting in the same location. If this continues for the maximum recordable time without any changes of channel states, a maximum-time gate 12 is operated and the main-store counter 7 is stepped, leaving a maximum-time signal in the main store. At the end of the console multiplexer period allocated to the timer function, the all-zero detector 9 is returned to normal, thus restoring data control to the console multiplex counter, by release of the gating switches 10.

When a channel difference is detected for the first time in any one scan, the main-store counter 7 is advanced before the channel address is recorded so that the existing time record is left undisturbed.

When a solid-state recording is to be played back, a Record/Play switch (not shown) effects the necessary circuit alterations so that the circuit has the configuration shown in FIG. 2, and a reset button (equivalent to 'rewind' on a tape recorder) restores the main-store counter 7 to zero or to a preset position. Data is then read out from the main store 8 one byte at a time. If the byte refers to timing, the multi-pole electronic switch 10 is switched to the timer outputs, or if it refers to organ channels, the electronic switch 10 is set to the counter outputs of the console multiplexer 3. In the former case, successive scans of the working store 1 take place without alteration until the timer, counting the scans, reaches the count specified by the byte of main-store data, whereupon the main-store counter 7 is advanced one step; whereas in the latter case action takes place when the console multiplex counter 2 reaches the specified channel. At that point the state of the working store 1 is reversed and the main-store counter 7 is advanced to the next byte.

Sensing of the correspondence between timer and main-store data output or between console channel and main-store output is effected by eight exclusive-OR gates 13 followed by an 8-way NAND gate 14. When correspondence is reached the NAND gate 14 furnishes an output which, when strobed by S1, sets a latch 15. Strobe S2 then either resets the timer 11 to zero or writes the 9th bit into the working store 1, as determined by the data of the 10th bit. Strobe S3 then advances the main-store counter 7 and S4 cancels the latch 15 in readiness for the next sequence of operations.

During playback the output of the working store 1 controls the console modulator 21, thus transmitting over line 22 to the receiver-demultiplexer (not illustrated) a reproduction of the time-division-multiplex signal originally generated by the console. At the same time, normal modulation of the signal can take place from the console multiplexer 3 so that a live performance can be superimposed on the playback if desired.

During normal playback the timer 11 is driven from the last stage of the console multiplex counter 2 as for recording, but provision is made for reducing the rate of the timer 11 (preferably, but not necessarily, by a factor of 2, 4 or 8 to avoid beat phenomena between timer and scanner) to allow critical examination of the recording at a reduced speed. Provision is also made for disconnecting the timer and advancing the main-store counter 7 byte by byte.

In order to enable editing, three hexadecimal display units (not shown) may be provided for identification of main-store locations for editing purposes, although more may be provided for larger instruments. These hexadecimal display units also serve to indicate, during recording, the extent to which storage has been filled, bearing in mind that occupation of storage is not directly proportional to time. Two further hexadecimal displays may be provided to show the data recorded in the eight bits of the currently-addressed byte.

A suitable keyboard is needed to insert amendments and additions to the main-store data. The organ console itself forms the ideal method of inserting note or stop data and could also be used for writing timing signals. In this case such signals will be limited to those corresponding, in the first 8 bits, to console controls but this is a tolerable restriction. However, if the entry of such data from the organ keyboard is not desired, the data can be entered from an orthodox data keyboard.

It is not believed to be necessary to give fully detailed circuitry for the operations to be effected by edit instructions, as there are many known ways in which edit instructions can be implemented.

The above descriptions have been given in terms of a pipe organ, but the invention is applicable to any musical instrument which can be adapted to digital control, in particular the electronic organ and the piano.

Application to the electronic organ requires only the adaptation of the multiplexer and demultiplexer to interface with the circuits of the organ. The invention may be applied to the whole electronic organ or, for economy, may be restricted to selected parts, for example the atonal percussion effects, in which case fewer than 8 bits will usually suffice for the addressing of the channels, with consequent economy.

Application to the piano requires the addition of touch sensitivity. Three or four extra bits can be readily included in the data byte for this purpose, giving 8 or 16 degrees of touch sensitivity. In one of the known ways the force with which each note is played is measured by noting the time taken for the key to move between two contacts, the first of which is broken at the beginning of the note's travel and the second of which is closed at or near the end of the travel. The present recording system may be used to assist in this known method.

The transit time between the contacts varies between about 5 milliseconds for a note played loudly and 40 milliseconds for a pianissimo note. It is convenient for the piano keyboard to be scanned in about two and a half milliseconds. A convenient size of multiplexer for the 88 notes of a piano is 96 channels in a $12\times8$ format and this allows approximately 25 microseconds per channel and uses a 7-bit address system.

The multiplexer is arranged to sense the three possible states of each note, i.e. off, on, and in transit. A working store RAM is provided of a size to allow 4 bits per channel. When the output of the multiplexer indicates that the channel is 'off', the four bits are written into the working store as zeros. When the channel is 'in transit' the relevant four bits are read out from the working store, increased by one unit on a four-digit binary number basis, and written back into the working store with that increase. Thus the numerical significance of the four bits is increased by one every two and a half milliseconds during the transit time. This action ceases when the multiplexer output shows 'on' and the final state of the four bits is a measure of the transit time and therefore, inversely, of the force with which the note was struck. The address of the note is then written into the main store in the same way as already described for an organ, and the four extra bits are also written to provide a record of the force with which the note was struck. Thus the main store for the piano embodiment requires four extra bits per byte for this purpose, but one less on account of the fewer channels.

When the state of the four bits has been written into the main store they are set to all-ones in the working store which serves as an indication during succeeding scans that no further record is to be made. It is assumed that the 1111 state would correspond to a note played so softly as to be ineffective.

When the note is released, the fact is detected, and four zeros are written into the working store and, with the address, into the main store as an 'off' instruction on playback. Between channel data recordings in the main store, timing signals showing the times between changes of state are inserted as already described for the organ.

For the playback of a piano recording, the recorded channel data are used to energise electromagnets which operate the piano mechanism. Unlike the organ with its remote pipes, the piano will contain the playback apparatus and it is therefore unnecessary to convert the channel data to time-division form for serial transmission. The seven address bits therefore directly control decoding circuitry. Whereas the organ only requires one latch per channel to hold the pipe on of off, the piano is provided with four latches per channel which are set by the four data bits, which, as described above, provide the required touch sensitivity.

Various methods may be devised for using the four latches to control the force developed by the magnet operating a note. It is not intended that this specification shall teach any such method; it is merely shown that this invention is able to record and play back the necessary data defining the force.

The invention having thus been described in terms of hard-wired logic, a more modern method of implementation using a microprocessor will not be outlined. It will be described in terms of a Zilog Z80A processor, but it is to be understood that other types may be used.

In general, it is likely than an organ to be associated with this invention will be equipped with a multiplexed form of transmission between the console and the pipes such as described, for example, in my U.S. Pat. No. 4,088,051 in which case it will usually be practicable to feed the multiplexed signal to the microprocessor through a single input port for the purpose of recording and to feed an output from the microprocessor to the modulator of the transmission system via a single output port. If no such multiplexed system exists it will be necessary to provide suitably multiplexed input and output ports to give access from and to the orthodox multi-wire transmission cable connecting the console to the pipes mechanisms. The output ports will need to be suitably latched so that they remain in either the OFF or the ON state as set by the microprocessor output. Such multiplexing systems are well known and no further description of them seems necessary.

FIGS. 7A and 7B show flow charts for microprocessor control of the system. For simplicity only the main flows are shown, but it is to be understood that provision would be made for stopping and starting in either RECORD or PLAYBACK modes, including sequences for initialising the system for the desired purpose.

In accordance with convention the processor's internal registers, each of 8 bits, will be referred to as A, B, C, D, E, H, and L. D and E and H and L are used in pairs to provide 16-bit addresses. At the start of recording, the states of the channels as recorded in a part of the main read/write memory assigned to be the "working store" are set to OFF and the main data store address register HL is set to a suitable starting address. Register DE is used to address the "working store"; except in the case of a large organ D will remain fixed and E alone will suffice to determine a channel address.

To record, each channel of the organ (whether notes, stops, or other controls) is examined in turn via the multiplexer to determine whether it is OFF or ON, and the result is compared with the state of that channel as recorded in the working store. If no change has occurred then no action is required and consideration passes to the next channel. If a change has occurred register HL is incremented to the next memory address and the channel address as shown by register E is written into that address; also the timer register C is set to the zero-time code as the elapsed time up to that moment will already have been stored at the previous HL address. The working store for the channel in question is then updated to show the new state of the channel, and consideration then passes to the next channel. Thus all channel changes occurring within the period of one complete scan are recorded at consecutive addresses of the main memory without limit on the number of such changes, but if no changes have occurred no memory addresses are taken up. Thus there is no wastage of memory capacity.

At the end of each scan the time register C is examined. If it shows the zero time-code (which is not necessarily an arithmetic zero) this indicates that at least one channel change has been recorded during the scan and HL is therefore standing on the address at which the last such change was recorded in the main memory; HL is therefore incremented to provide an appropriate new address for a new time-record. If C shows the maximum-time code, HL is similarly incremented in order to leave the maximum-time on record and start a further time-period. Thus an unlimited time period can be built up, if necessary, as a series of time-codes with no channel changes interspersed. If C shows a value between zero and maximum, HL is not incremented as there is obviously room for a further increment in the current time record. C is now incremented and its value is written into memory at the address shown by HL. If HL has not been incremented this will overwrite the previous entry. The channel address, DE, is zeroed and the scan is repeated.

Thus, all changes of state are recorded and whenever a scan is completed without any such changes the elapsed time is overwritten into memory until the permitted maximum is reached whereupon a new address is provided for recording additional time.

Playback consists of reading the contents of the main memory in sequence and taking the appropriate action for each byte of data. Firstly, all o/p ports are set OFF, HL is set to the start position and the time register C is zeroes. The memory at address HL is examined to determine whether it contains a channel code or a time code. If it is a channel code the o/p port corresponding to that channel is reversed (i.e. if it is OFF it is set ON, or vice versa) via the o/p port multiplexer. Alternatively, if the recording system is associated with a multiplexed transmission system the change of state may be registered in the same working store as was used for recording and that store may be scanned in synchronism with the transmission multiplexer to provide a modulating signal for mixing with the console modulation. If, however, the code read from the main memory is a time code, the system waits until register C has been incremented to reach the value of that time code. The incrementing of C is by time pulse, which may take the form of an "end-of-scan" signal if the multiplexing system is such that it runs at a suitable rate.

PROVISION FOR LARGE INSTRUMENTS

It has already been shown that when the required number of channels exceeds the capacity of an 8-bit code the implementation by hard-wired logic is easily extended to include one or more additional bits per word, each additional bit serving to double the channel capacity. Clearly, microprocessor control can be similarly expanded by using a 16-bit microprocessor, but this is unnecessarily extensive. A preferred method is as follows: the Z80A (8-bit) is retained and one of the 256 8-bit codes, for example 11111111 (FF in hexadecimal notation), is reserved to indicate that the next byte is to be regarded as referring to a second group of 256 codes. Thus, 255 of the codes (i.e. excluding FF) remain available as one-byte codes to be used for the most frequently used keyboards while a further 255 codes are formed as double bytes which are used for the less-used keyboards and the stops. Thus the double-rate usage of memory is confined to the least-used channels. The microprocessor is easily programmed to recognise FF as the first half of a double byte. If necessary, other prefixes e.g. FE, FD, etc. can be used to extend the system to deal with very large organs. The largest known organ (in Atlantic City, U.S.A.) has approximately 1800 control channels. A multiplexer can easily scan this number 50 times per second, and by the use of seven sets of double-byte codes the whole recording system can readily be applied even to such an exceptionally large instrument.

I claim:

1. A recording and playback system for a keyboard musical instrument, comprising:

means for providing successive outputs indicative of the state of operation of keys of a keyboard instrument whilst being played, comparison means responsive to said successive outputs for providing digital change of state signals indicative of an occurence of a change of state of key operation and defining an address representative of which of the keys has changed its state, timing means for developing digital timing signals representative of time intervals between successive changes of state of key operation, said timing signals being coded so as to be distinguishable from the change of state signals, solid state memory means operative to store said change of state signals and said timing signals, and playback means for retrieving stored signals from the memory means, the playback means including means for distinguishing between the retrieved change of state signals and the retrieved timing signals for enabling playback by means of the keyboard instrument.

2. A system according to claim 1 including multiplexer means for successively sampling said outputs indicative of the state of operation of the keys, and wherein said comparison means includes a working store for storing a first set of samples of said outputs produced by the multiplexer means, and comparator logic for comparing the samples stored in the working store with a subsequent set of samples produced by the multiplexer means to provide an indication of a change of state of key operation.

3. A system according to claim 1 including address register means associated with said solid state memory means and arranged to define a predetermined sequence of addresses for the memory means, the address register means being operative to direct a said change of state signal followed by a said timing signal followed by the next said change of state signal to sequential ones of the addresses in said address sequence.

4. A system according to claim 1 for a keyboard instrument having player operable controls additional to the keys, including:

means for providing successive control outputs indicative of the state of operation of said controls whilst the instrument is being played, and wherein the comparison means is additionally responsive to said control outputs for producing a digital change of state signal indicative of the occurence of a change of state of said player operable controls and defining an address representative of which of the controls has changed its state, and said timing means is operative to produce timing signals representative of time intervals between successive changes in state of said key and said player operable controls.

5. A system according to claim 4 in combination with a keyboard operated pipe organ wherein said additional controls comprise organ stops.

6. A system according to claim 5 wherein said additional controls include foot pedals.

7. A system according to claim 1 including magnetic storage media means, and means for transferring signals stored in the solid state memory means between said memory means and the magnetic storage media means.

* * * * *